US005540467A

United States Patent [19]

Briffa

[11] Patent Number: 5,540,467

[45] Date of Patent: Jul. 30, 1996

[54] AUTOMOBILE VANDALISM DETERRENT DEVICE

[76] Inventor: Franklin S. Briffa, 497 Manitou Rd., Hilton, N.Y. 14468

[21] Appl. No.: 263,834

[22] Filed: Jun. 21, 1994

[51] Int. Cl.[6] ..... E05C 19/18

[52] U.S. Cl. ..... 292/288; 292/289

[58] Field of Search ..... 292/288, 289, 292/291, 292, 259, 339, 295; 160/105, DIG. 2

[56] References Cited

U.S. PATENT DOCUMENTS

| | | | |
|---|---|---|---|
| 1,467,363 | 9/1923 | Fairall . | |
| 1,876,556 | 9/1932 | Boden | 292/339 |
| 2,130,216 | 9/1938 | Zaninovich | 292/219 R |
| 3,480,247 | 11/1969 | Waner | 292/338 |
| 3,486,781 | 12/1969 | Crum | 292/262 |
| 3,606,421 | 9/1971 | Reichenbach | 292/1 |
| 3,615,114 | 10/1971 | Harris | 292/262 X |
| 3,797,005 | 3/1974 | Schwarz | 292/262 |
| 3,917,331 | 11/1975 | Duran | 292/338 |
| 3,977,712 | 8/1976 | Narthrop | 292/338 |
| 4,105,233 | 8/1978 | Levey | 292/288 |
| 4,846,513 | 7/1989 | Mathis, III | 292/288 |
| 4,971,374 | 11/1990 | Lovell et al. | 292/339 |

*Primary Examiner*—Steven N. Meyers
*Assistant Examiner*—Monica E. Millner
*Attorney, Agent, or Firm*—Cumpston & Shaw

[57] ABSTRACT

A device for deterring automobile vandalism includes two telescopically engaged elongate members each of which has a plain end and an arcuate, blade shaped, window channel engaging end. The blade shaped ends are arcuate to displace the elongate body of the device away from the window pane so the device can be used whether the window is open or closed. A bushing is attached over the plain end of the first elongate member and includes an inner sidewall telescopically received in the plain end of the first member to add rigidity to the device and to fix the length of the device as desired. The inner and outer sidewalls of the bushing each have aligned holes through which a threaded stud having a thumb screw on one end can be screwed until the other end of the stud engages the sidewall of the second member. In another version of the device, the plain end of the telescopically received second member is flared and fitted with a plug, and the first member contains a spring, and is crimped after assembly so that the second member can not be ejected from the first member due to the restoring force of the spring. In each version, the bushing can be seated on the plain end of the first member in which case the first member has a hole in the sidewall thereof aligned with the holes in the bushing for the stud to pass through.

18 Claims, 3 Drawing Sheets

AUTOMOBILE VANDALISM DETERRENT DEVICE

FIELD OF THE INVENTION

This invention, referred to hereinafter as the "Biff Stick™" window bar, relates to a device for deterring automobile vandalism, particularly carjacking.

BACKGROUND OF THE INVENTION

An open car window provides convenient access to the interior of a vehicle for someone intent upon reaching into the vehicle to remove an object or for access to a person sitting in the vehicle. While this type of access is often a convenience, it also provides an entry port for acts of vandalism on occupants and objects inside. The related art discussed below does not address this concern, or is impractical for the application described herein.

U.S. Pat. No. 3,204,981 describes a removable window guard comprising an elongated element of spring steel or other slightly elastic, but form retaining, material which is bent into a configuration substantially blocking the window opening when the device is positioned in the window frame.

U.S. Pat. No. 4,653,562 relates to an automobile window guard which permits ventilation when the window is open, but prevents projection of animal or human extremities through the area covered by the guard. The device is made of two complementary screen elongate members which slidably fit into a frame which then fits into the window frame of the vehicle.

U.S. Pat. No. 4,854,364 describes a pet barrier which is readily adaptable to various vehicle window shapes by reason of a multitude of horizontally adjustable members which abut opposite window frame locations. These elongate members are supported by spring biased upright posts which interconnect the main horizontal members for securing the barrier in the window frame.

Each of the devices described in the above referenced patents is intended to keep occupants of the vehicle captive therein when the vehicle's window is in an open position, and in addition, are bulkier, require more time to install and remove, and are not as conveniently storable as the Biff Stick™ window bar.

Accordingly, the inventor has recognized a need for a strong, light weight, highly visible device which is selectively positionable in the channel of an automobile window frame; which is easily installable and removable; which is unobstructive to the act of driving; and which is conveniently storable when not in use.

SUMMARY OF THE INVENTION

According to the invention, a device for deterring automobile vandalism by releasably engaging and traversing a window receiving channel in an automobile, comprises a first elongate member including an arcuate, blade shaped window channel-engaging end and a non window channel-engaging, or plain, end, and a second elongate member including an arcuate, blade shaped window channel-engaging end and a non window channel-engaging, or plain, end, in which the non window channel-engaging end and a variable portion of the second elongate member is telescopically engaged with the first elongate member, further in which the variable portion of the second elongate member has a length that is releasably fixable with respect to the first elongate member, whereby the overall length of the device can be adjusted to engage opposite locations in window frames of various sizes. As assembled, the tips of the blade shaped ends can be positioned coplanar and are not collinear with a common longitudinal axis of the elongate member, wherein the opposed, arcuate ends displace the elongate members a sufficient distance away from a windowpane occupying the channel when the device is installed in the window frame so that use of the device is possible regardless of whether the window is open or closed.

In one embodiment of the invention, a bushing mounted on the plain end of the first elongate member is employed for varying and fixing the length of the device. The bushing includes at least one sidewall having a bore therethrough for receiving a threaded stud which engages the side wall of the telescopically received second elongate member, for releasably fixing the device at the appropriate length.

In a different aspect of this embodiment, the first elongate member also has a hole in the side wall thereof near the plain end which is aligned with the bores in the bushing side walls to receive therethrough the threaded stud for fixing the length of the device.

In another embodiment, a biasing means such as a spring, for example, is disposed in the first elongate member between the blade shaped end and the plain end. The plain end of the second elongate member is flared and, optionally, fitted with a plug, and is telescopically received in the first elongate member; the plugged, flared end surface thus engaging an end of the spring in the first elongate member.

In one aspect of this embodiment, the first elongate member is crimped to make its inner diameter at the crimped location smaller than the outer diameter of the flared end of the second elongate member, as a means for preventing disengagement of the two elongate members due to the restoring force of the spring.

In another aspect of the invention, either of the bushing components described in the former embodiment may be incorporated as optional reinforcing means for the device, and for fixing the length of the device to accommodate vehicle window frames of varying sizes.

It will be appreciated that the means for varying and fixing the length of the device is not intended to be limited to the bushing assembly as claimed, but may comprise such other mechanisms including a tapered, elongate member and a threaded nut, or sleeve, engaged with at least one of the elongate members at the telescopic juncture of the members, wherein, as is known in the art, the nut or sleeve has a tapering inner diameter to engage the tapered elongate member depending upon the rotation direction of the nut/sleeve. Alternatively, one of the elongate members could have a series of holes engagable with a locking bar; or detents engagable with a biased catch located on the other elongate member, for releasably fixing the length of the device to fit various window frames.

In each aspect of the invention described above, the blade shaped ends of the Biff Stick™ window bar are sufficiently flattened to engage the window channel without twisting. In addition, the arcuate design of the blade shaped ends displaces the elongate members a sufficient distance from the windowpane when the vehicle window is closed so that the Biff Stick™ window bar can be used regardless of whether the window is open or closed.

It is therefore an object of this invention to provide a device for thwarting automobile vandalism which can be installed to traverse a vehicle window frame when the window is opened or closed.

It is another object of the invention to provide a strong, rigid, light weight and highly visible device for positioning in the window frame of a vehicle to deter would be vandals from entering the vehicle through the window.

It is another object of the invention to provide a device as indicated above which can be quickly and easily installed and removed, and conveniently stored when not in use.

These and other objects and advantages of the invention will become more apparent when viewed with the drawings and the detailed description which follow.

DETAILED DESCRIPTION OF THE INVENTION

Figure 1:
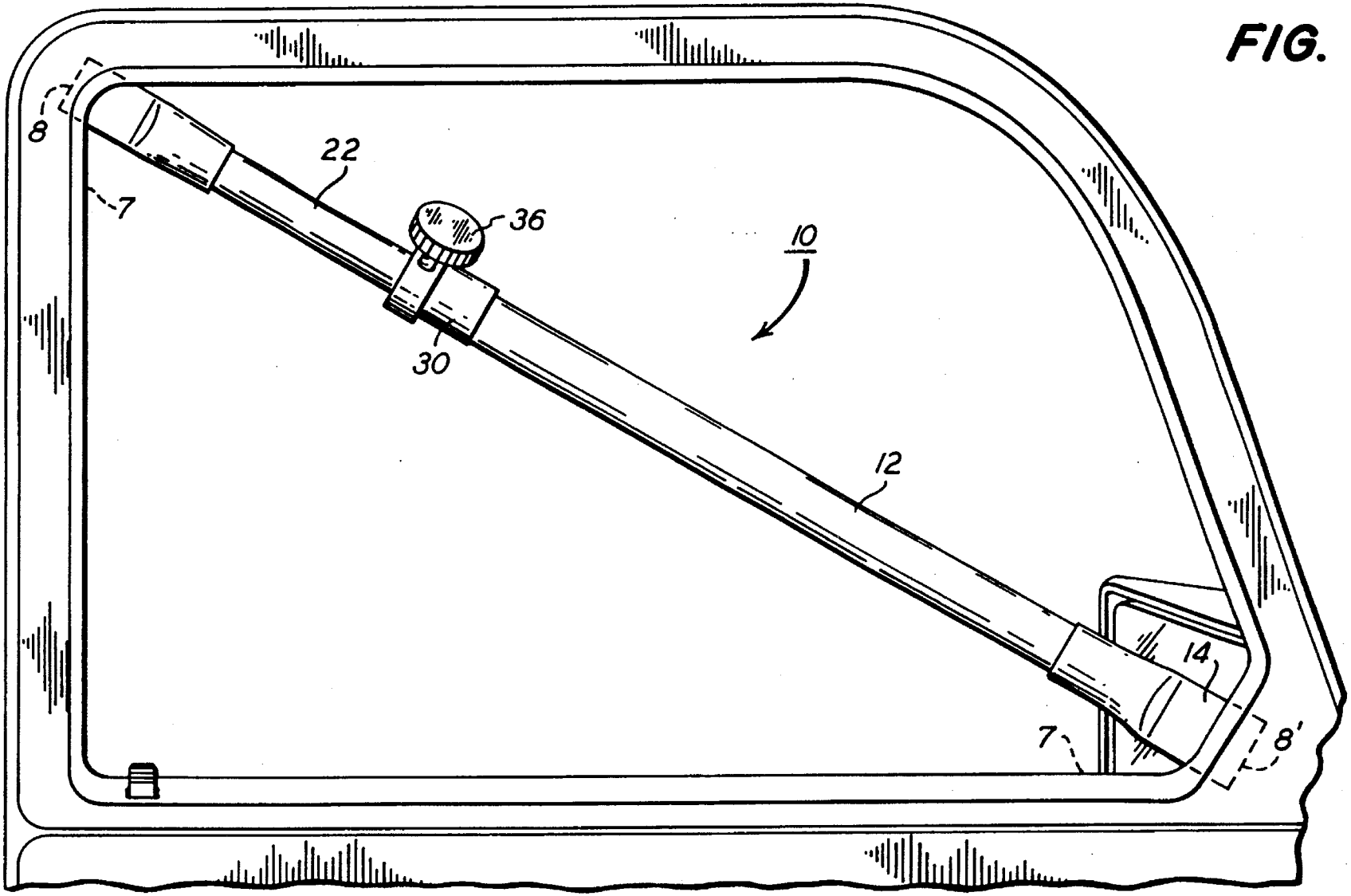
FIG. 1 is a schematic, side elevational view of a Biff Stick™ window bar installed in an automobile driver's side window frame.
Figure 2:
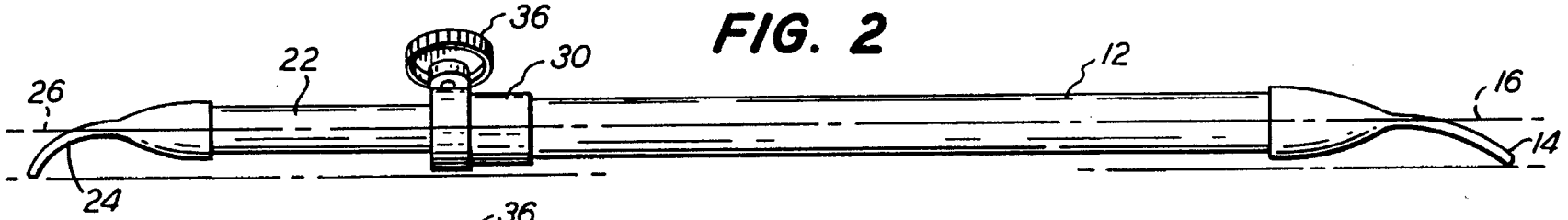
FIG. 2 is a side elevational view of the Biff Stick™ window bar showing the relationship between the arcuate, blade shaped ends of the device and the elongate body of the device.
Figure 3:
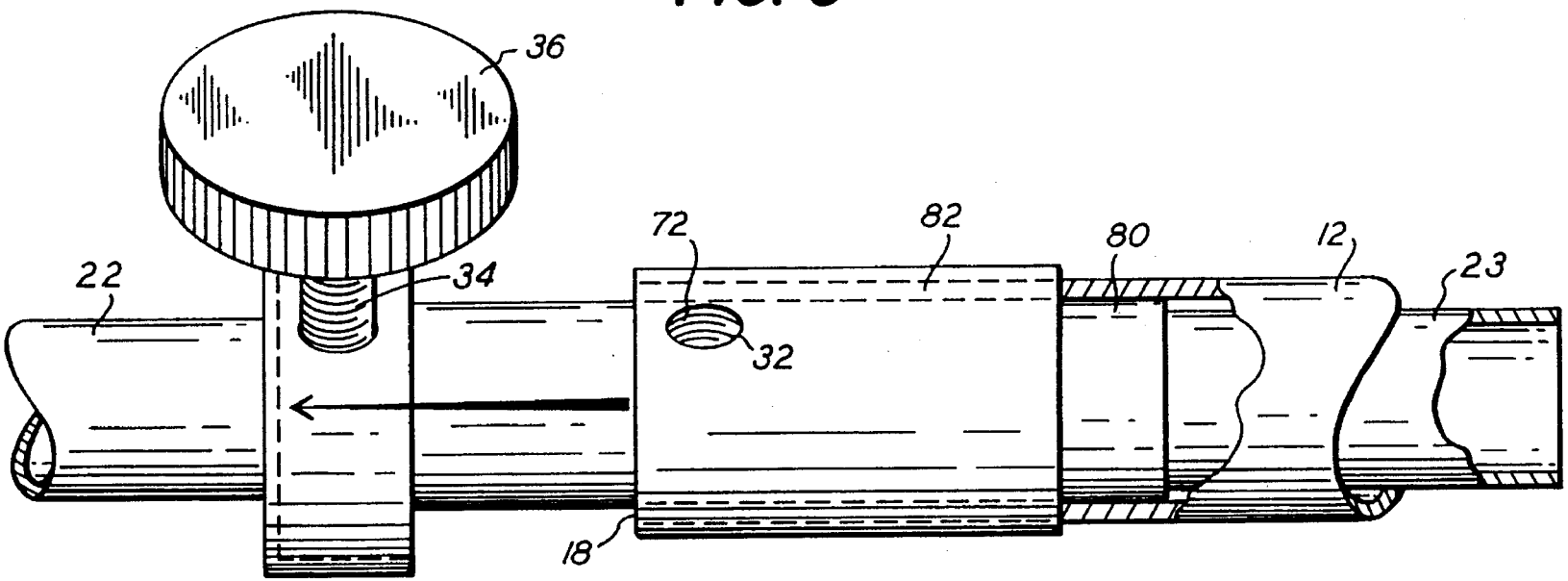
FIG. 3 is an exploded cutaway view of an embodiment of the Biff Stick™ window bar showing one aspect of the bushing in which the bushing collar fits substantially over the plain end of the first elongate member.

In one embodiment of the invention 10, as shown in FIGS. 1–3, the Biff Stick™ window bar comprises a first elongate member 12 having a plain end 18 and an arcuate, blade shaped end 14. A second elongate member 22 has a plain end 28 and an arcuate, blade shaped end 24, similar to that of the first elongate member. The first elongate member 12 has an inner diameter sufficient to slidably receive the plain end 28 and a body portion 23 of the second elongate member therein such that the blade shaped ends 14, 24 are opposed. As shown in FIG. 2, the tips of the blade shaped ends 14, 24 can be positioned coplanar, and are not collinear with a common longitudinal axis 26 of the elongate members. The arcuate nature of the blade shaped ends 14 and 24 displaces the body of the Biff Stick™ window bar sufficiently away from the vehicle window so that the device can be used when the window is either open or closed. The Biff Stick™ window bar further includes means for varying and fixing the length of the device when the first and second elongate members 12, 22 are engaged as described above, to allow the blade shaped ends 14, 24 to securely engage opposite locations 8, 8' in the vehicle window frame channel 7.

In one aspect of the invention, the means for varying and fixing the length of the Biff Stick™ window bar includes a bushing 30 mounted over the plain end 18 of the first elongate member 12. The bushing 30 has an inner side wall 80 which slides inside the plain end 18 of the first elongate member 12, and an outer side wall 82 having a length shorter than that of the inner side wall 80, which slides over the outside of plain end 18. The bushing 30 has a bore through the inner and outer side walls 80, 82 for receiving a threaded stud 34 including a thumb knob 36 mounted on one end of the stud 34. In one embodiment, the side wall 72 of the first elongate member 12 has a hole adjacent the plain end 18 which is aligned with the bore 72 in the bushing when the bushing is fully seated on the plain end of the first elongate member. When the Biff Stick™ window bar is extended to its desired length, the threaded stud 34, engaged in the bore in the bushing and the hole in the sidewall, is rotated via the thumbscrew until a first end of the stud contacts the sidewall of the second elongate member 22, thus fixing its position with respect to the first elongate member.

Figure 4:
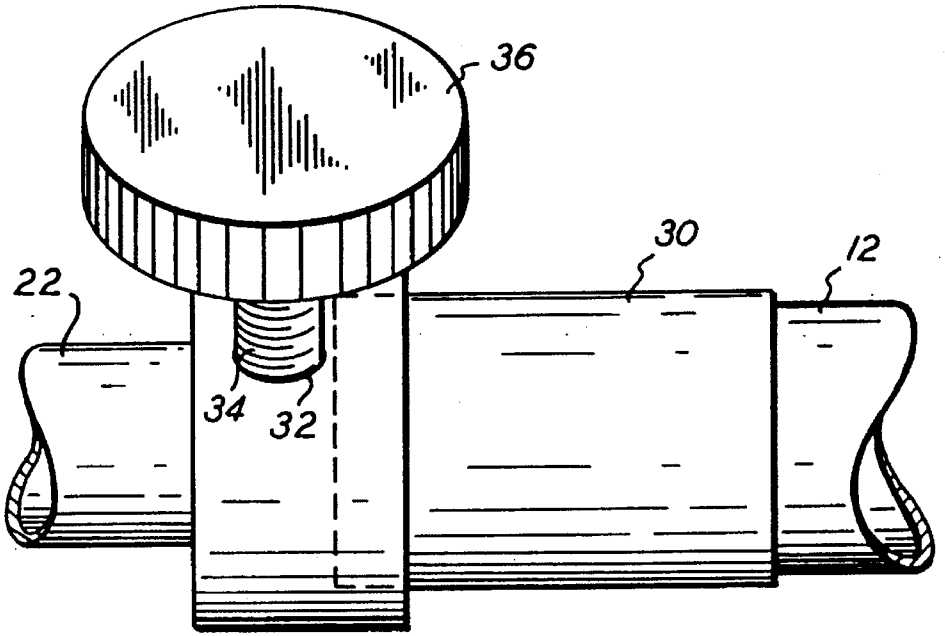
FIG. 4 shows an aspect of the bushing in which the bushing collar extends past the plain end of the first elongate member.

In another aspect of the invention, the bushing, as shown in FIG. 4, fits into and over the plain end 18 of the first elongate member 12 as described above, but does not seat against the plain end, leaving that portion of the bushing having a hole through its sidewalls extending past the plain end of the first elongate member. Accordingly, the first elongate member 12 is not required to have a hole in a side wall thereof near the plain end and aligned with the hole in the bushing in order for the threaded stud to engage the second elongate member when the device has been adjusted to the desired length.

Figure 5:
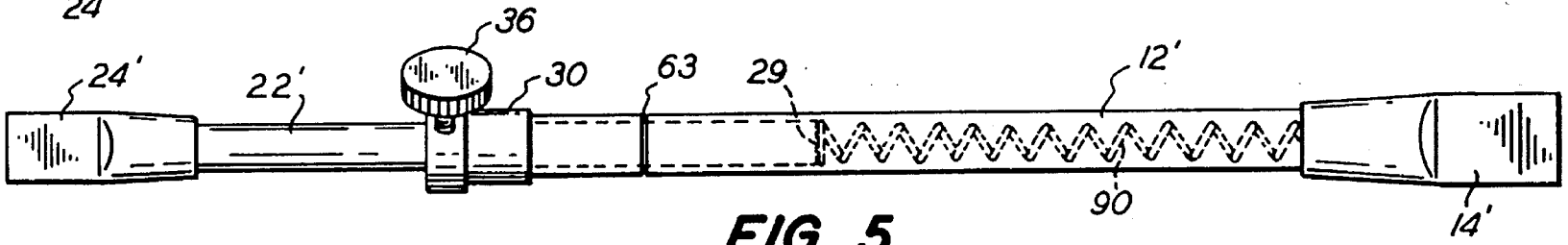
FIG. 5 shows another embodiment of the Biff Stick™ window bar in which the second elongate member is spring biased within the first elongate member.
Figure 6:
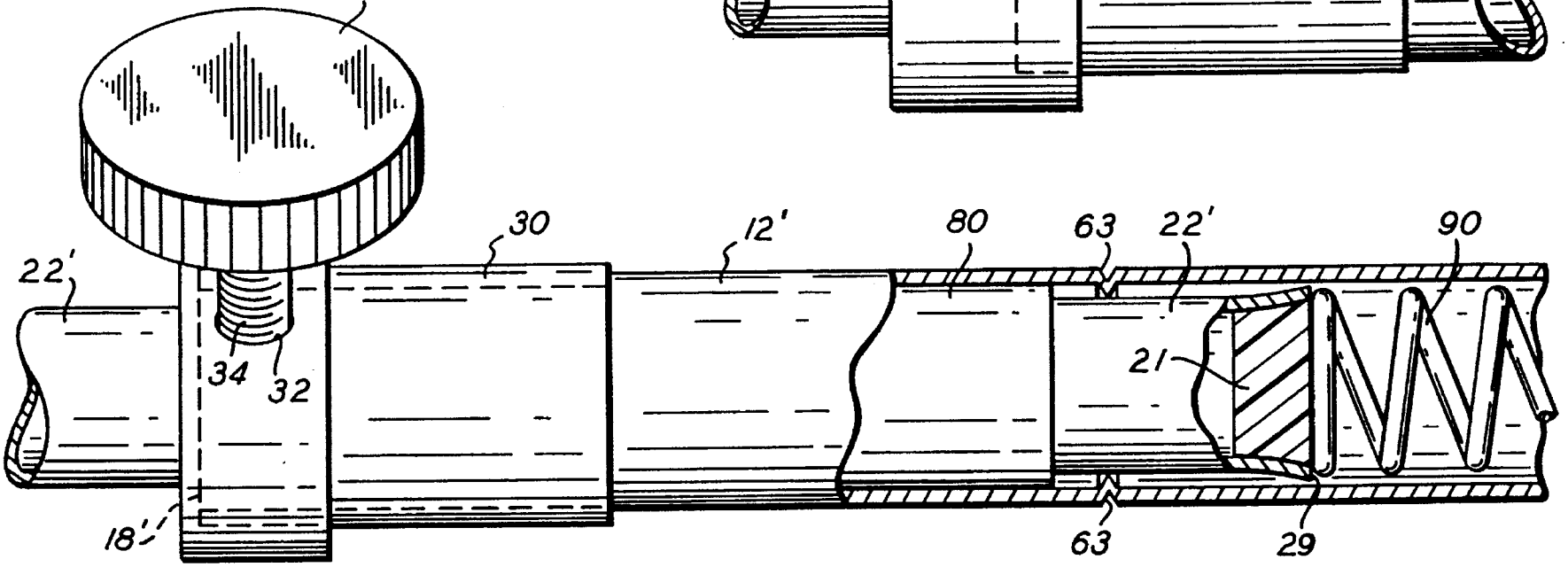
FIG. 6 is an enlarged view of the Biff Stick™ window bar embodiment of FIG. 5 showing the flared end of the second elongate member, and the first elongate member including a crimp for retaining the second elongate member against the restoring force of the biasing means.

In another aspect of the invention as shown in FIGS. 5 and 6, the Biff Stick™ window bar comprises a first elongate member 12' having a plain end 18' and an arcuate, blade shaped end 14'. A second elongate member 22' includes an arcuate, blade shaped end 24' which is positionable coplanar with end 14', neither of which ends are collinear with longitudinal axis 26 of the device, and a flared end 29. Biasing means, such as a spring 90, is disposed within the first elongate member 12' such that one end of the spring is adjacent the blade shaped end 14' of the first elongate member and the other end of the spring engages the exposed surface of a plug 21 occupying the flared end 29 of the second elongate member 22'. The first elongate member 12' is crimped as at 63 after the second elongate member has been inserted within the first elongate member to the extent that the inner diameter of the first elongate member at the crimped region is less than the outer diameter of the flared end 29 of the second elongate member. The difference in diameters thus prevents the second elongate member from being ejected from the first elongate member due to the restoring force of the biasing means.

In an aspect of this embodiment, either version of the bushing described above can be used for varying and fixing the length of the Biff Stick™ window bar and for adding rigidity to the Biff Stick™ window bar in the region of the bushing. As before, the plain end 18' of the first elongate member 12' will have a hole in a side wall thereof adjacent the plain end if the bushing is seated on the plain end of the first elongate member; and similarly as before, the first elongate member need not have a hole in the side wall if the nonseating bushing described above is employed.

In a preferred aspect of each embodiment of the invention, the Biff Stick™ window bar is constructed of tubular steel having a galvanized coating in any of a variety of bright colors for high visibility. Each of the elongated members are 24 inches in length; the outer diameter of the second elongate member being 15/16 inch and the outer diameter of the first elongate member being 11/16 inch, each elongate member having a wall thickness of 1/16 inch. The blade shaped, arcuate ends of the device are overcoated with a resilient rubber or plastic type material to avoid marring the surface of the window channel. It will be appreciated, however, that other dimensions suitable for using the Biff Stick™ in smaller or larger window frames, and other materials such as fiberglass or plastic, for example, will have sufficient Strength and rigidity for construction and application of the device. In all aspects of the invention, the arcuate, blade shaped ends of the Biff Stick™ window bar are preferably overcoated with a resilient material to prevent marring of the window channel when the device is installed.

A person skilled in the art will appreciate that the invention as described is subject to minor changes and modifications without altering the scope of the invention as set forth in the appended claims.

What is claimed:

1. A device for deterring automobile vandalism by releasably engaging a window receiving channel in an automobile, comprising:

a first elongate member terminating at one end in a window channel engaging curved, blade shaped tip and having a plain other end;

a second elongate member terminating at one end in a window channel engaging curved, blade shaped tip and having a plain other end, in which the first member has an inner diameter sufficient to telescopically receive the plain end and a portion of the second member;

a bushing mounted on the plain end of the first member including an inner sidewall telescopically received in the plain end of the first member and having a bore therethrough, and an outer sidewall which encircles the plain end of the first member and having a bore therethrough aligned with the bore through the inner sidewall;

a threaded stud cooperatively engaging the bores for selectively contacting a first end of the stud with the second member; and a knob attached to a second end of the stud for turning the stud.

2. The device of claim 1 in which the blade shaped tips are positionably coplanar and are not collinear with a common longitudinal axis of the elongate members.

3. The device of claim 1 in which the blade shaped tips of the members have a resilient overcoating.

4. A device for deterring automobile vandalism by releasably engaging a window receiving channel in an automobile, comprising:

a first elongate member terminating at one end in a window channel engaging curved, blade shaped tip and having a plain other end with a hole in a sidewall thereof adjacent the plain end;

a second elongate member terminating at one end in a window channel engaging curved, blade shaped tip and having a plain other end, in which the first member has an inner diameter sufficient to telescopically receive the plain end and a portion of the second member:

a bushing seated on the plain end of the first member including an inner sidewall telescopically received in the plain end of the first member defining an inner diameter of the bushing sufficient to slidably receive therethrough the plain end and a portion of the second member, and an outer sidewall telescopically received over the plain end of the first member;

a bore through the inner and outer sidewall of the bushing aligned with the hole in the first member;

a threaded stud for cooperatively engaging the bore having a sufficient length to contact a first end of the stud with the second member for releasably securing the second member within the first member at a desired position; and a knob connected to a second end of the stud for turning the stud in the bore.

5. The device of claim 4 in which the blade shaped tips of each member includes a resilient overcoating.

6. A device for deterring automobile vandalism by releasably engaging a window receiving channel in an automobile, comprising:

a first elongate member including an arcuate, channel engaging end adapted to fit within the channel and a plain end;

a second elongate member including an arcuate, channel engaging end adapted to fit within the channel and a flared end, in which the first member has an inner diameter sufficient to telescopically receive the flared end and a portion of the second member therein; and biasing means for telescopically extending the length of the device.

7. The device of claim 6 in which the arcuate ends are blade shaped.

8. The device of claim 7 in which the blade shaped ends are positionably coplanar and are not collinear with a common longitudinal axis of the elongate members.

9. The device of claim 7 in which the biasing means comprises a spring disposed within the first member intermediate the arcuate end thereof and the flared end of the received second member.

10. The device of claim 9 further comprising a plug fitted in the flared end of the second member.

11. The device of claim 9 in which the first member is crimped at a perimetal location between the arcuate end and the plain end thereof so that the inner diameter of the first member at the crimped location is smaller than the diameter of the flared end of the second member.

12. The device of claim 9 further comprising a bushing attached to the plain end of the first member including an outer wall encircling the plain end and an inner wall extending within the plain end of the first member.

13. The device of claim 12 in which the bushing has a hole in both of the inner and outer side walls thereof, and further comprising a threaded stud engageable with the holes having a first end and a second end, and knob means attached to the second end for turning the stud.

14. The device of claim 13 further in which the first member has a hole in a sidewall thereof adjacent the plain end which is in axial alignment with the holes in the bushing.

15. A device for deterring automobile vandalism by releasably engaging a window receiving channel in an automobile, comprising:

a first elongate member including an arcuate, blade shaped, channel engaging end adapted to fit within the channel and a plain end having a hole in a sidewall thereof adjacent the plain end;

a second elongate member including an arcuate, blade shaped, channel engaging end adapted to fit within the channel and a plain end, telescopically receivable in the plain end of the first member, in which the blade shaped ends are positionably coplanar and are not collinear with a longitudinal axis of the first and second members;

a bushing seated on the plain end of the first member including an inner sidewall telescopically received in the plain end of the first member having a bore therethrough and an outer sidewall telescopically received over the plain end of the first member having a bore therethrough aligned with the bore in the inner sidewall, both of which bores are aligned with the hole in the first member;

a threaded stud for cooperatively engaging the bores and having a sufficient length to contact a first end of the stud with the second member for releasably securing the second member within the first member at a desired position; and knob means connected to a second end of the stud for turning the stud in the bore.

16. The device of claim 15 in which the arcuate end of each member includes a resilient overcoating.

17. A device for deterring automobile vandalism by releasably engaging a window receiving channel in an automobile, comprising:

a first elongate member including an arcuate, blade shaped, channel engaging end and a plain end having a hole in a sidewall thereof adjacent the plain end and having a crimp located around a perimetal portion intermediate the plain end and the arcuate end;

a second elongate member including an arcuate, blade shaped, channel engaging end and a flared end, telescopically receivable in the plain end of the first member, in which the blade shaped ends are positionably coplanar and are not collinear with a longitudinal axis of the first and second members;

a plug fitted in the flared end of the second member;

a spring disposed within the first member intermediate the arcuate end thereof and the plugged, flared end of the second member;

a bushing seated on the plain end of the first member including an inner sidewall telescopically received in the plain end of the first member having a bore therethrough and an outer sidewall telescopically received over the plain end of the first member having a bore therethrough aligned with the bore in the inner sidewall, both of which bores are aligned with the hole in the first member;

a threaded stud for cooperatively engaging the bores and having a sufficient length to contact a first end of the stud with the second member for releasably securing the second member within the first member at a desired position; and knob means conneted to a second end of the stud for turning the stud in the bore.

18. The device of claim 7 in which the arcuate end of each member includes a resilient overcoating.

* * * * *